United States Patent [19]

Pilla

[11] Patent Number: 4,984,634

[45] Date of Patent: Jan. 15, 1991

[54] LOGGING OF SUBTERRANEAN WELLS USING COILED TUBING

[75] Inventor: Jacques Pilla, St. Remy Les Chevreuse, France

[73] Assignee: Dowell Schlumberger Incorporated, Tulsa, Okla.

[21] Appl. No.: 485,187

[22] Filed: Feb. 26, 1990

[51] Int. Cl.[5] ..... E21B 43/00; E21B 47/00

[52] U.S. Cl. ..... 166/250; 166/65.1; 166/385; 166/372

[58] Field of Search ..... 166/250, 264, 385, 252, 166/372, 65.1, 77

[56] References Cited

U.S. PATENT DOCUMENTS

| | | | |
|---|---|---|---|
| 3,373,816 | 3/1968 | Cochran | 166/77 |
| 3,722,589 | 3/1973 | Smith et al. | 166/250 |
| 4,326,411 | 4/1982 | Gant et al. | 73/155 |
| 4,682,657 | 7/1987 | Crawford | 166/77 X |
| 4,715,446 | 12/1987 | Wittrisch | 166/250 X |
| 4,725,783 | 2/1988 | Miyairi et al. | 166/65.1 X |
| 4,790,378 | 12/1988 | Montgomery et al. | 166/72 X |

*Primary Examiner*—Stephen J. Novosad

*Attorney, Agent, or Firm*—Stephen A. Littlefield

[57] ABSTRACT

An apparatus for production logging of a well utilizing artificial lift in a wellbore comprises coiled tubing extending into the wellbore, the coiled tubing having gas injector means provided on its remote end and including means for electrical communication from the surface to the injector means; production logging tool means located within the wellbore at a distance so as to separate the logging tool from the injector means and connector means interconnecting the logging tool and the injector means for maintaining a fixed separation between the logging tool and the injector means and for effecting electrical communication from the production logging tool to the electrical communication means located within the injector means.

5 Claims, 1 Drawing Sheet

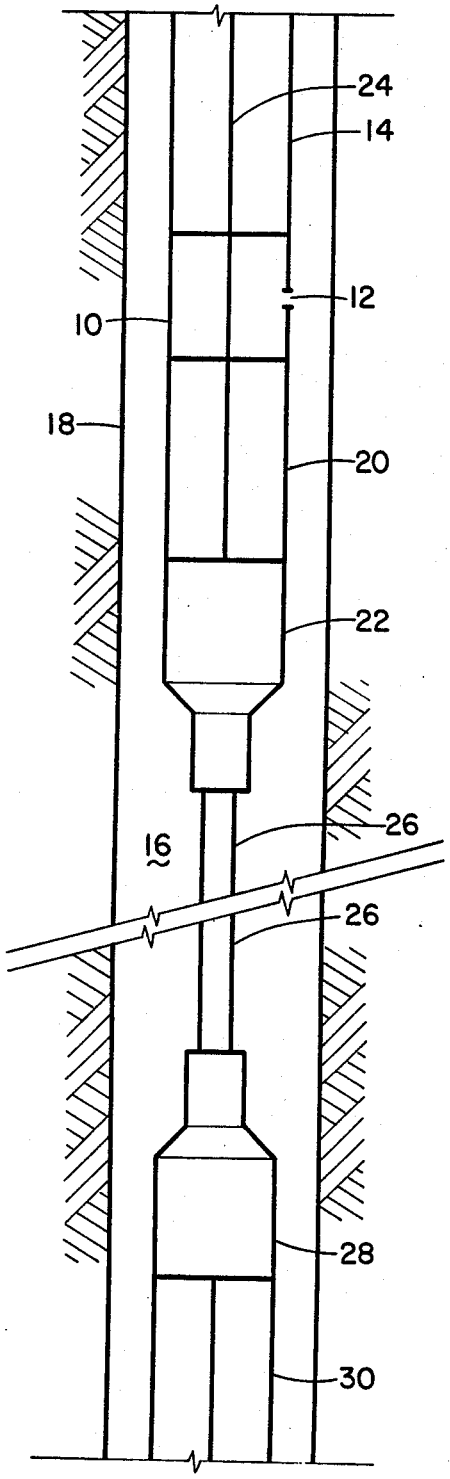
24
14
12
10
18
20
22
26
16
26
28
30

LOGGING OF SUBTERRANEAN WELLS USING COILED TUBING

This invention relates to the art of subterranean fluids and the exploitation of such fluids and, more particularly, to a means and method for logging various well parameters during the process of injection of fluids into a well utilizing coiled tubing.

BACKGROUND OF THE INVENTION

In the exploitation of subterranean fluids, particularly petroleum, it is generally desirable to determine the flow characteristics from the reservoir into a borehole drilled from the surface into the subterranean, petroleum-containing formation. When there is sufficient bottom-hole pressure, formation fluids flow naturally into the wellbore and upwardly to the surface. Flow characteristics of the reservoir can be simply determined either by gauging at the surface or by lowering a production logging tool containing a propeller-type flow meter therein into the wellbore.

Some difficulty arises, however, when there is insufficient bottom-hole pressure to produce wellbore fluids to the surface. The hydrostatic column of fluid within the wellbore restricts reservoir fluid entry to the formation face or into the wellbore through the perforations. In order to overcome this hydrostatic column and produce fluids from the well, it is well known in the art to provide "artificial lift" of fluids by injecting a gas, preferably nitrogen, into the wellbore at a depth sufficient to artificially lift wellbore fluids to the surface.

One common way of achieving artificial lift utilizing nitrogen injection is described in U.S. Pat. No. 3,722,589. This technique utilizes coiled tubing which is stored as a continuous length of small diameter pipe on a reel located at the surface. The tubing is injected into the wellbore by a well-known coiled tubing operations employing a tubing injector head located at or near the wellhead. Once the remote end of the coiled tubing has reached the proper depth for gas injection, it is a relatively simple matter of pumping the gas through the coiled tubing to produce the desired artificial lift.

Attempts have been made to log the flow within a wellbore in order to determine various reservoir parameters during the production of wellbore fluids by artificial lift utilizing gas injection with coiled tubing. Some difficulties have been noted in interpreting the data received. Although it is unknown what the true source of the inaccuracies or even the extent of the such inaccuracies may be, it appears that the nature of the apparatus used for such logging may be the source. Typically, the logging tool has been mounted on the coiled tubing immediately below the gas injection orifice. It is therefore possible that nitrogen bubbles are being entrained in the wellbore fluid which is passing through the propeller flow meter of the logging tool. Furthermore, hydrodynamic effects resulting from the injection of the gas into the wellbore fluid may be causing swirls, eddies and the like which may also have an adverse effect on the accuracy of the measurement as determined by the flow meter propeller. Finally, due to the size of the pumping equipment commonly employed with coiled tubing, it is necessary to pump relatively large amounts of gas through the apparatus, a condition which may not facilitate the production of the best data in conjunction with a production logging tool attached to the gas injection tool on coiled tubing.

SUMMARY OF THE INVENTION

The present invention provides a means and method whereby the effects of gas injection are minimized or eliminated in an artificial lift process including a determination of flow characteristics of the reservoir utilizing a production logging tool.

In accordance with the invention, an apparatus for production logging of a well utilizing artificial lift in a wellbore comprises coiled tubing extending into the wellbore, the coiled tubing having gas injector means provided on its remote end and including means for electrical communication from the surface to the injector means; production logging tool means located within the wellbore at a distance so as to separate the logging tool from the injector means and connector means interconnecting the logging tool and the injector means for maintaining a fixed separation between the logging tool and the injector means and for effecting electrical communication from the production logging tool to the electrical communication means located within the injector means.

Further in accordance with the invention, a method of logging the production from a wellbore utilizing artificial lift comprises inserting production logging means into the wellbore, inserting coiled tubing having a gas injector means located thereon above the gas injector means, and maintaining a fixed separation between the production logging tool and the gas injector means while injecting gas into the wellbore fluids.

It is therefore an object of this invention to provide a means and method of logging the production of a subterranean well utilizing gas lift which avoids the interferences caused by the injection of gas in the vicinity of a production logging tool.

BRIEF DESCRIPTION OF THE DRAWINGS

The invention is further described in conjunction with the accompanying drawing illustrating a preferred embodiment of the invention in the form of various parts and arrangement of parts and forming a part of this specification in which the sole FIGURE illustrates the preferred relationship between a gas injector tool on the end of coiled tubing, a production logging tool and an intermediate electrical cable/spacer member in accordance with the invention.

DETAILED DESCRIPTION OF THE PREFERRED EMBODIMENT AND THE DRAWINGS

Recording of production parameters for a non-eruptive well, that is one which does not have sufficient bottom hole pressure to produce flow through the borehole to the surface, can be done by attaching a production logging tool to coiled tubing apparatus having a wireline passing therethrough and by producing the well using artificial gas lift such as by the injection of nitrogen into the wellbore fluids.

The difficulty in this arrangement is avoiding interference in the measurement between the actual flow of fluids passed the sensors and the disturbance to the flow caused by the injection of the gas into the fluid. In order to acquire data free from influence of the gas injection, in accordance with the invention, the production logging tool is preferably suspended from the end of the coiled tubing and its associated gas injection tool with a spacer member which allows electrical wireline connection between the sensors and the wireline cable in the coiled tubing. This removes the logging tool from the influence of gas injection such as entrainment of the gas in the wellbore fluid, hydrodynamic effects of the injection of gas into the fluid and the like.

Furthermore, limiting the amount of gas supplied to the fluid for gas lift is difficult when normal 1¼ inch coiled tubing and its associated pumping equipment is used. The prior art as represented by U.S. Pat. No. 3,722,589, overcomes this difficulty by utilizing coiled tubing of a very small diameter which is uncommon in the art and not useful with other types of normal coiled tubing tools. The present invention allows for the use of normal coiled tubing tool sizes, capacities and flow rates and allows for the adjustment of the effects or gas lift by adjusting the distance of separation between the gas injection tool and the production logging tool through the use of a variable length of spacer. The separation distance required for a desired flow rate using artificial lift by gas injection can be easily calculated by those skilled in the art utilizing the gas delivery rate, the size of the annular space between the coiled tubing and the wellbore casing, etc.

Referring now to the drawing wherein the showing is for purposes of illustrating a preferred embodiment of the invention only and not for the purpose of limiting same, the sole FIGURE illustrates schematically the desired assembly of the apparatus in accordance with the invention. As shown in the FIGURE, a gas injector tool 10 having at least one gas port 12 is located generally on the lower end of a string of coiled tubing 14 within a wellbore 16 having a well casing 18. With the injection of a gas such as nitrogen through the coiled tubing 14 and out into the wellbore 16 through the gas port 12, fluids within the wellbore 16 will be artificially lifted to flow upwardly within the wellbore as is well known in the art.

In accordance with the invention, the gas injection tool 10 has connected to its lowermost end an adaptor member 20 which acts to interconnect the gas injection tool 10 with a first wireline cable head connector 22. A wireline 24, allowing electrical communication from the surface to the cable head, passes through the coiled tubing 14, the gas injector tool 10, the adaptor 20 and is connected to the electrical connectors within the first cable head 22.

Below the first cable head 22, a support spacer 26 extends downwardly to a second cable head connector 28 and establishes electrical communication between the first cable head 22 and the second cable head 28. The second cable head 28 is then connected to a production logging tool 30 in accordance with standard wireline logging connection procedures. The production logging tool 30 can then log the flow rate of fluids upwardly within the wellbore 16.

As stated previously, the length of the spacer member 26 may be adjusted to a length which will accomplish the desired ends of both removing the production logging tool from the effects of gas injection and allow for the adjustment of the flow rate of wellbore fluids within the wellbore 16 relative to an available flow rate of gas through the coiled tubing and out the port 12 of the gas injection tool 10. Generally, the length of the spacer member 26 is varied between about 100 feet to in excess of 1000 feet.

While the invention has been described in the more limited aspects of a preferred embodiment thereof, other embodiments have been suggested and still others will occur to those skilled in the art upon a reading and understanding of the foregoing specification. It is intended that all such embodiments be included within the scope of this invention as limited only by the appended claims.

Having thus described my invention, I claim:

1. An apparatus for production logging of a well utilizing artificial lift in a wellbore comprising coiled tubing extending into the wellbore having wireline electrical cable passing through a central bore thereof and having a remote end within the wellbore which end is connected to gas injector means, said wireline cable passing through said gas injector means to a flexible electrically conductive support spacer having an end portion remote from said gas injector means and logging means connected to said end portion of said support spacer.

2. The apparatus as set forth in claim 1 wherein said logging means is a production logging tool.

3. The apparatus as set forth in claim 1 further including standard wireline cable head connectors connecting said support spacer to said gas injector means, said wireline electrical cable and said logging means.

4. A method of logging the production of a well utilizing artificial lift comprising the steps of:

(a) suspending production logging means from gas injector means within a wellbore utilizing an electrically conductive spacer;

(b) connecting the gas injector means to coiled tubing means having an electrically conductive cable passing through an internal bore and connecting the electrically conductive cable to the electrically conductive spacer;

(c) lowering the gas injector means or the coiled tubing into the wellbore;

(d) injecting gas through the coiled tubing and outwardly into the wellbore through the gas injector means, and (e) logging the flow within the well with the production logging means.

5. The method as set forth in claim 4 wherein the step of injecting gas comprises injecting nitrogen.

* * * * *